US008641175B2

(12) United States Patent
Panchawagh et al.

(10) Patent No.: US 8,641,175 B2
(45) Date of Patent: Feb. 4, 2014

(54) VARIABLE DROP VOLUME CONTINUOUS LIQUID JET PRINTING

(75) Inventors: Hrishikesh V. Panchawagh, San Jose, CA (US); Michael A. Marcus, Honeoye Falls, NY (US); Shashishekar P. Adiga, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/530,171

(22) Filed: Jun. 22, 2012

(65) Prior Publication Data

US 2013/0342597 A1 Dec. 26, 2013

(51) Int. Cl.

| | |
|---|---|
| ***B41J 2/085*** | (2006.01) |
| ***B41J 29/38*** | (2006.01) |
| ***B41J 2/205*** | (2006.01) |
| ***B41J 2/07*** | (2006.01) |
| ***B41J 2/02*** | (2006.01) |

(52) U.S. Cl.

USPC ..... 347/76; 347/10; 347/15; 347/74; 347/75

(58) Field of Classification Search

USPC ..... 347/10, 15, 74, 75, 76

See application file for complete search history.

(56) References Cited

U.S. PATENT DOCUMENTS

| | | | |
|---|---|---|---|
| 3,373,437 | A | 3/1968 | Sweet et al. |
| 3,596,275 | A | 7/1971 | Sweet |
| 3,656,171 | A | 4/1972 | Robertson |
| 4,068,241 | A | 1/1978 | Yamada |
| 4,613,871 | A | 9/1986 | Katerberg |
| 6,003,979 | A | 12/1999 | Schneider et al. |
| 6,135,655 | A | 10/2000 | Magirl |
| 6,273,559 | B1 | 8/2001 | Vago et al. |
| 6,406,115 | B2 | 6/2002 | Mantell et al. |
| 6,783,203 | B2 | 8/2004 | Fujimori |
| 7,192,121 | B2 | 3/2007 | Barbet et al. |
| 7,575,293 | B2 | 8/2009 | Snyder et al. |
| 7,637,585 | B2 | 12/2009 | Serra et al. |
| 7,712,879 | B2 | 5/2010 | Barbet |
| 7,938,516 | B2 | 5/2011 | Piatt et al. |

(Continued)

FOREIGN PATENT DOCUMENTS

| | | |
|---|---|---|
| EP | 0 354 982 | 2/1990 |

OTHER PUBLICATIONS

Lord Rayleigh, "On the Instability of Jets," *Proc. London Math.* Soc. X (1878).

(Continued)

*Primary Examiner* — Jannelle M Lebron
(74) *Attorney, Agent, or Firm* — William R. Zimmerli

(57) ABSTRACT

A liquid jet includes a fundamental period of jet break off. A print period is defined as N times the fundamental period of jet break off where N is an integer greater than 1. Input image data is provided having M levels per input image pixel including a non-print level where M is an integer and 2<M≤N+1. A charging device waveform, independent of the input image data, repeats during print periods and includes print and non-print drop voltage states. A drop formation device waveform, having a period equal to the print period, is selected in response to the input image data to form from the jet print drops having a volume corresponding to an input image pixel level. The devices are synchronized to produce a print drop charge to mass ratio and a non-print drop charge to mass ratio on drops breaking off from the jet.

19 Claims, 9 Drawing Sheets

(56) References Cited

U.S. PATENT DOCUMENTS

| | | | | |
|---|---|---|---|---|
| 2006/0098036 | A1* | 5/2006 | Gardner | 347/10 |
| 2008/0030533 | A1* | 2/2008 | Suzuki | 347/10 |
| 2010/0238511 | A1 | 9/2010 | Neese | |

OTHER PUBLICATIONS

Panchawagh, H. et al., U.S. Appl. No. 13/115,434, "Ejecting Liquid Using Drop Charge and Mass", filed May 25, 2011.

Panchawagh, H. et al., U.S. Appl. No. 13/115,465, "Liquid Ejection System Including Drop Velocity Modulation", filed May 25, 2011.

Panchawagh, H, et al., U.S. Appl. No. 13/115,482, "Liquid Ejection Method Using Drop Velocity Modulation", filed May 25, 2011.

Panchawagh, H. et al., U.S. Appl. No. 13/115,421, "Liquid Ejection Using Drop Charge and Mass", filed May 25, 2011.

* cited by examiner

| | | | |
|---|---|---|---|
| 4 | 3 | 0 | 1 |
| 3 | 4 | 2 | 0 |
| 0 | 2 | 4 | 0 |
| 1 | 0 | 0 | 4 |

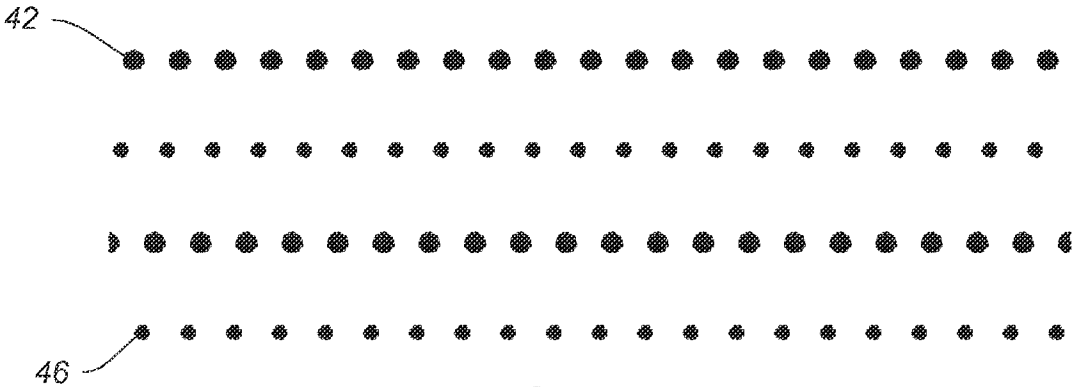
FIG. 8A
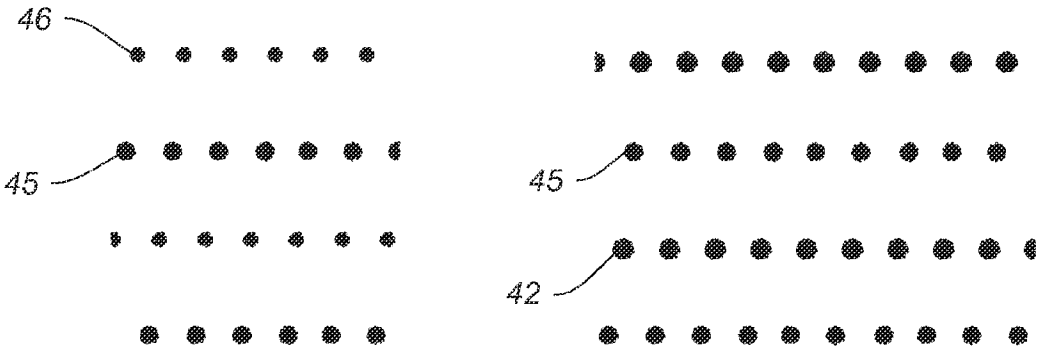
FIG. 8B
FIG. 8C

VARIABLE DROP VOLUME CONTINUOUS LIQUID JET PRINTING

FIELD OF THE INVENTION

This invention relates generally to the field of digitally controlled printing systems, and in particular to continuous printing systems in which a liquid stream breaks into drops some of which are deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TH)."

The second technology commonly referred to as "continuous" ink jet (CIJ) printing, uses a pressurized ink source to produce a continuous liquid jet stream of ink by forcing ink, under pressure, through a nozzle. The stream of ink is perturbed in a manner such that the liquid jet breaks up into drops of ink in a predictable manner. Printing occurs through the selective deflecting of some of the drops and the catching of ink drops that are not intended to strike the print media. Various approaches for selectively deflecting drops have been developed including electrostatic deflection, air deflection, and thermal deflection mechanisms.

In a first electrostatic deflection based CIJ approach, the liquid jet stream is perturbed in some fashion causing it to break up into uniformly sized drops at a nominally constant distance, the break off length, from the nozzle. A charging electrode structure is positioned at the nominally constant break off point so as to induce a data-dependent amount of electrical charge on the drop at the moment of break off. The charged drops are then directed through a fixed electrostatic field region causing each droplet to deflect proportionately to its charge. The charge levels established at the break off point thereby cause drops to travel to a specific location on a recording medium or to a gutter for collection and recirculation. This approach is disclosed by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (an array) of drop emitting nozzles each with its own charging electrode. This approach requires that each nozzle have its own charging electrode, with each of the individual electrodes being supplied with an electric waveform that depends on the image data to be printed. This requirement for individually addressable charge electrodes places limits on the fundamental nozzle spacing and therefore on the resolution of the printing system.

In conventional CIJ printers, there is variation in the charge on the print drops caused by image data-dependent electrostatic fields from neighboring charged drops in the vicinity of jet break off and electrostatic fields from adjacent electrodes associated with neighboring jets. These input image data dependent variations are referred as electrostatic cross talk. Katerberg disclosed a method to reduce the cross-talk interactions from neighboring charged drops by providing guard gutter drops between adjacent print drops from the same jet in U.S. Pat. No. 4,613,871. However, electrostatic cross talk from neighboring electrodes limits the minimum spacing between adjacent electrodes and therefore resolution of the printed image. Thus, the requirement for individually addressable charge electrodes in traditional electrostatic CIJ printers places limits on the fundamental nozzle spacing and therefore on the resolution of the printing system. A number of alternative methods have been disclosed to overcome the limitation on nozzle spacing by use of an array of individually addressable nozzles in a nozzle array and one or more common charge electrodes at constant potentials. This is accomplished by controlling the jet break off length in methods described by Vago et al. in U.S. Pat. No. 6,273,559 and by B. Barbet and P. Henon in U.S. Pat. No. 7,192,121. T. Yamada disclosed a method of printing using a charge electrode at constant potential based on drop volume in U.S. Pat. No. 4,068,241. B. Barbet in U.S. Pat. No. 7,712,879 disclosed an electrostatic charging and deflection mechanism based on break off length and drop size using common charge electrodes at constant potentials.

One well-known problem with any type inkjet printer, whether drop-on-demand or continuous ink jet, relates to the accuracy of dot positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and print drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas.

High speed and high quality inkjet printing requires that closely spaced drops of relatively small volumes are accurately directed to the receiving medium. Since ink drops are usually charged there are drop to drop interactions between adjacent drops from adjacent nozzles in a CIJ printer. These interactions can adversely affect drop placement and print quality. In electrostatic based CIJ printer systems using high density nozzle arrays, a significant source of drop placement error on a receiver is due to electrostatic interactions between adjacent charged print drops.

As the pattern of drops traverse from the printhead to the receiving medium (throw distance), through an electrostatic deflection zone, the relative spacing between the drops progressively changes depending on the print drop pattern. When closely spaced print drops from adjacent nozzles are similarly charged while traveling in air, electrostatic interactions will cause the spacing of these adjacent neighboring print drops to increase as the print drops travel toward the receiving medium. This results in printing errors which are observed as a spreading of the intended printed liquid pattern in an outward direction and are termed "splay" errors or cross-track drop placement errors herein. Since splay errors increase with increasing throw distance it is required that the throw distance be as short as possible which adversely affects print margin defined as the separation between print drops and gutter drops.

In inkjet printing, it is sometimes desirable to use of a halftone technique to improve the capability of producing various levels of gradation for mid tone shades. Halftone is the reprographic technique that simulates continuous tone imagery through the use of dots, varying either in size, in shape or in spacing. As an example, black and white continuous tone photographs contain millions of shades of gray. When printed, these shades of gray are converted to a pattern of black dots that simulates the continuous tones of the original image. Lighter shades of gray consist of fewer or smaller black dots spaced far apart. Darker shades of gray contain more or larger black dots with closer spacing. U.S. Pat. No. 7,637,585 by M. Serra et al. describes a halftone printing drop on demand inkjet printer that forms different sized dots on the media by depositing different patterns of adjacent drops that coalesce into the different sized dots.

In CIJ printers it has been difficult to print simultaneously with different sized drops in order to produce a multi-tone image. As such, there is an ongoing need to provide a high print resolution continuous inkjet printing system that can produce different sized drops on a recording medium using a single nozzle array of all the same size nozzle orifice. There is also a need to provide such a printing system with an electrostatic deflection mechanism to deflect selected print drops using an individually addressable nozzle array and a common charge electrode in order to provide a simplified design, improved print image quality and an improved print margin.

SUMMARY OF THE INVENTION

According to an aspect of the present invention, a method of ejecting liquid drops includes providing liquid under pressure sufficient to eject a liquid jet through a nozzle of a liquid chamber with the liquid jet including a fundamental period of liquid jet break off. A drop formation device is associated with the liquid jet. A print period is defined as N times the fundamental period of liquid jet break off where N is an integer greater than 1. Input image data is provided having M levels per input image pixel including a non-print level where M is an integer and $2<M\leq N+1$. A charging device is provided and includes a charge electrode associated with the liquid jet and a source of varying electrical potential between the charge electrode and the liquid jet. The source of varying electrical potential provides a waveform to the charge electrode. The waveform repeats at least once during every print period. The waveform includes one or more print drop voltage states and one or more non-print drop voltage states. The waveform is independent of the input image data.

The liquid jet is modulated using the drop formation device to selectively cause portions of the liquid jet to break off into a sequence of print drops and a non-print drops traveling along an initial path by providing a plurality of waveforms to the drop formation device. Each of the plurality of waveforms has a period equal to the print period. Each waveform is selected in response to the input image data to form a print drop having a volume that corresponds to the level of the input image pixel. For example, a waveform can be selected to control timing of jet break and drop formation of print drops and non-print drops during the print period in response to the input image data. The charging device and the drop formation device are synchronized to produce a print drop charge to mass ratio on print drops as they break off from the liquid jet and to produce a non-print drop charge to mass ratio on non-print drops as they break off from the liquid jet. The print drop charge to mass ratio and the non-print drop charge to mass ratio being different when compared to each other. At least one of the print drops and the non-print drops is caused to deviate from the initial path using a deflection device.

BRIEF DESCRIPTION OF THE DRAWINGS

In the detailed description of the example embodiments of the invention presented below, reference is made to the accompanying drawings, in which:

FIG. 7B showing printing of 1× size drops; FIG. 7C showing printing of 2× size drops; FIG. 7D showing printing of 3× size drops; and FIG. 7E showing printing of 4× size drops;

FIGS. 8A-8C show examples of printing various size drops on a recording medium with FIG. 8A showing 1× and 3× drops; FIG. 8B showing 1× and 2× drops; and FIG. 8C showing 2× and 3× drops.

DETAILED DESCRIPTION OF THE INVENTION

Figure 1:
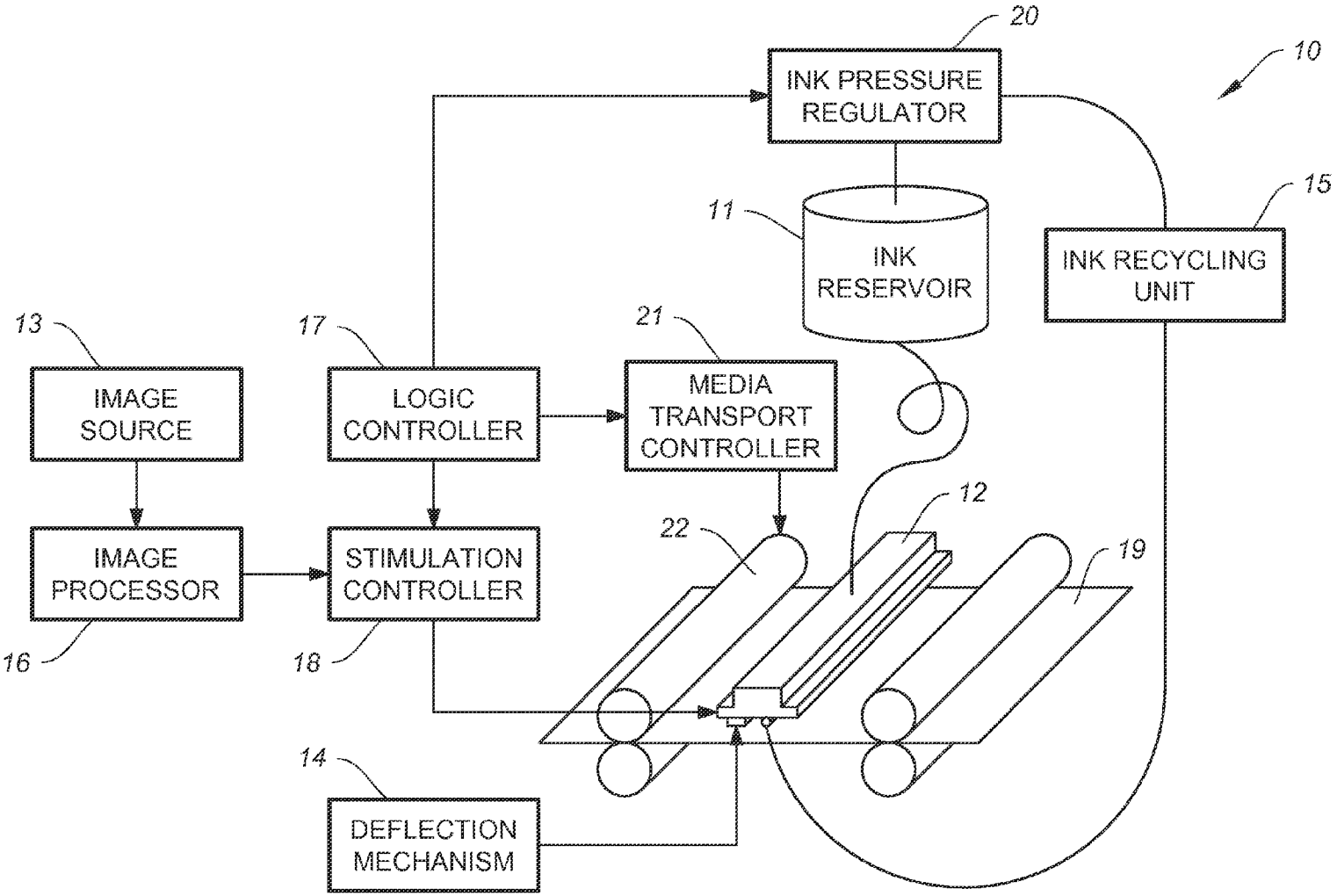
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a liquid jet of diameter dj, moving at a velocity vj. The jet diameter dj is approximately equal to the effective nozzle diameter do and the jet velocity is proportional to the square root of the reservoir pressure P. Rayleigh's analysis showed that the jet will naturally break up into drops of varying sizes based on surface waves that have wavelengths $\lambda$ longer than $\pi dj$, i.e. $\lambda \geq \pi dj$. Rayleigh's analysis also showed that particular surface wavelengths would become dominate if initiated at a large enough magnitude, thereby "stimulating" the jet to produce mono-sized drops. Continuous ink jet (CIJ) drop generators typically employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ (optimum Rayleigh frequency) the perturbation wavelength $\lambda$ is approximately equal to 4.5dj. The frequency at which the perturbation wavelength $\lambda$ is equal to $\pi dj$ is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal can be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, can be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Drops of predetermined volume each have an associated portion of the drop forming waveform responsible for the creation of the drop. Satellite drops don't have a distinct portion of the waveform responsible for their creation. Thus the phrase "predetermined volume" as used to describe the present invention should be understood to comprehend that some small variation in drop volume about a planned target value may occur due to unpredictable satellite drop formation.

A continuous inkjet printing system 10 is illustrated in FIG. 1, and

Figure 2:
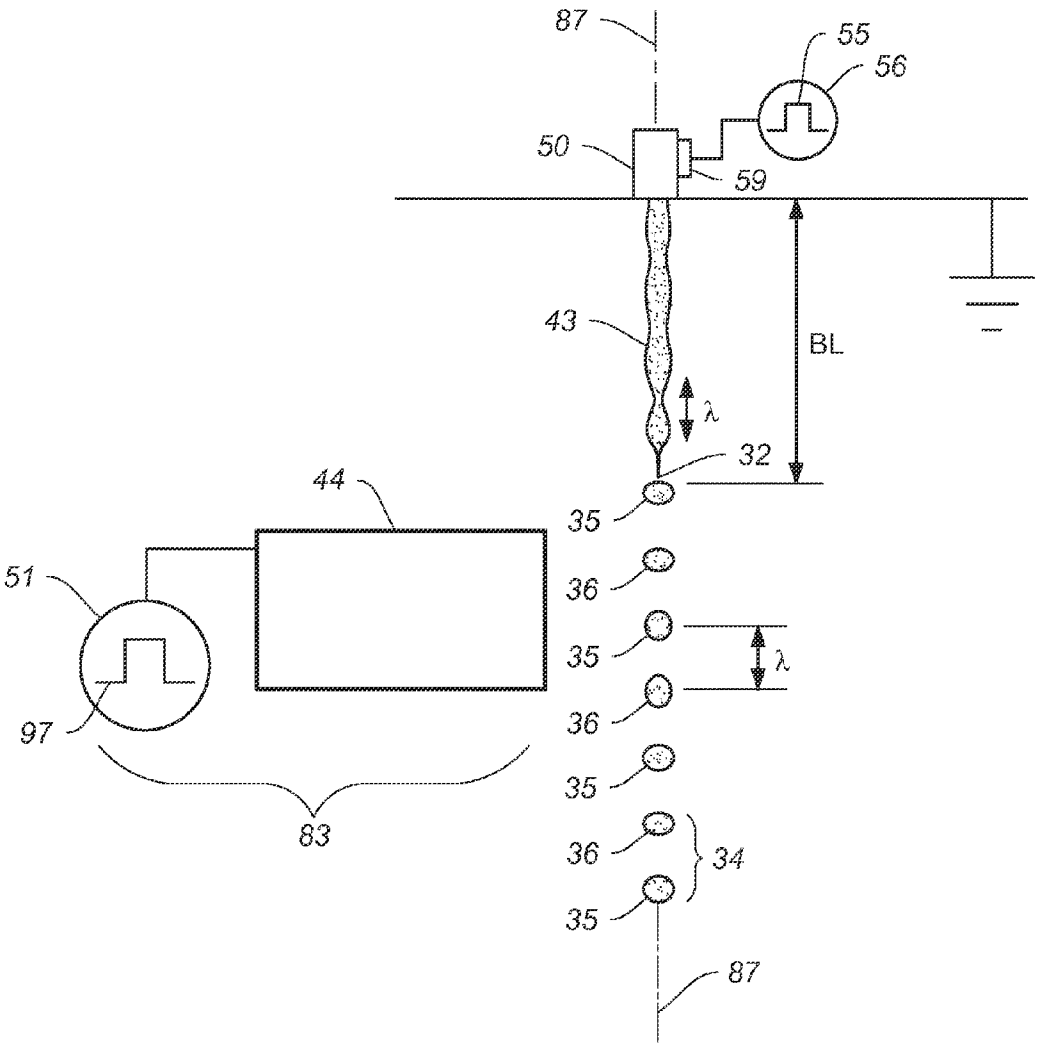
FIG. 2 shows an image of a liquid jet being ejected from a drop generator and its subsequent break off into drops at its fundamental period $\tau_o$ having a drop spacing $\lambda$.

FIG. 2 shows an image of a liquid jet 43 being ejected from a single drop generator of a printhead 12 and its subsequent break off into drops 35 and 36 at its fundamental period $\tau_o$ having an adjacent drop spacing $\lambda$. The continuous inkjet printing system 10 includes an ink reservoir 11 that continuously pumps ink into a printhead 12 also called a liquid ejector or drop generator to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP), which converts the received image data into print data, a bitmap of pixels for printing. The print data is sent to a stimulation controller 18, which generates stimulation waveforms 55; patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) 59 associated with each of the nozzles 50 with appropriate amplitudes, duty cycles, and timings to cause drops 35 and 36 to break off from the continuous stream 43. The printhead 12 and deflection mechanism 14 work cooperatively in order to determine whether ink droplets are printed on a recording medium 19 in the appropriate position designated by the data in image memory, or deflected and recycled via the ink recycling unit 15. The recording medium 19 is also called a receiver and it is commonly composed of paper, polymer, or some other porous substrate. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20.

The RIP or other type of processor 16 converts the image data to a pixel-mapped image page image for printing. Image data can include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

During printing, recording medium 19 is moved relative to printhead 12 by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises one or more stimulation waveform sources 56 that generate drop formation waveforms in response to the print data and provide or apply the drop formation waveforms 55, also called stimulation waveforms, to the stimulation device(s) 59 also called drop formation device(s) 59 associated with each nozzle 50 or liquid jet 43. In response to the energy pulses of applied stimulation waveforms, the drop formation device 59 perturbs the continuous liquid stream 43, also called a liquid jet 43, to cause individual liquid drops to break off from the liquid stream. The drops break off from the liquid jet 43 at a distance BL from the nozzle plate. The information in the image processor 16 thus can be said to represent a general source of data for drop formation, such as desired locations of ink droplets to be printed and identification of those droplets to be collected for recycling.

It can be appreciated that different mechanical configurations for receiver transport control can be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18 which can be generally referred to as a drop controller and are typically voltage pulses sent to the printhead 12 through electrical connectors, as is well-known in the art of signal transmission. However, other types of pulses, such as optical pulses, can also be sent to printhead 12, to cause printing and non-printing drops to be formed at particular nozzles, as is well-known in the inkjet printing arts. Once formed, printing drops travel through the air to a recording medium and later impinge on a particular pixel area of the recording medium or are collected by a catcher as will be described.

Referring to FIG. 2 the printing system has associated with it, a printhead that is operable to produce from an array of nozzles 50, all of the same diameter, an array of liquid jets 43. Associated with each liquid jet 43 are a drop formation device 59 and a drop formation waveform source 56 that supplies a stimulation waveform 55, also called a drop formation waveform, to the drop formation transducer. The drop formation device 59, commonly called a drop formation transducer or a drop stimulation transducer, can be of any type suitable for creating a perturbation on the liquid jet, such as a thermal device, a piezoelectric device, a MEMS actuator, an electrohydrodynamic device, an optical device, an electrostrictive device, and combinations thereof. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source 56 supplies a drop formation waveform having a fundamental frequency $f_o$ and a fundamental period of $\tau_o=1/f_o$ to the drop formation transducer, which produces a modulation with a wavelength $\lambda$ in the liquid jet. The modulation grows in amplitude to cause portions of the liquid jet break off into drops. Through the action of the drop formation device, a sequence of drops are produced at a fundamental frequency $f_o$ with a fundamental period of $\tau_o=1/f_o$. Typically the fundamental frequency $f_a$ for a printhead is chosen to be approximately equal to the optimum Rayleigh frequency $F_{opt}$.

In FIG. 2, liquid jet 43 breaks off into drops with a regular period at break off location 32, which is a distance BL from the nozzle 50. The distance between a pair of successive drops 35 and 36 is essentially equal to the wavelength $\lambda$ of the perturbation on the liquid jet. The pair of successive drops 35 and 36 that break off from the liquid jet forms is called a drop pair 34, each drop pair having a first drop and a second drop. Thus, the frequency of formation of drop pair 34, commonly called the drop pair frequency $f_p$, is given by $f_p=f_o/2$ and the corresponding drop pair period is $\tau_p=2\tau_o$. Usually the drop stimulation frequency of the stimulation transducers for the entire array of nozzles 50 in a printhead is the same for all nozzles in the printhead 12.

Also shown in FIG. 2 is a charging device 83 comprising charge electrode 44 and charging voltage source 51. The charging voltage source 51 provides a source of varying electrical potential between the charge electrode and the liquid jet. The source of varying electrical potential provides a charge electrode waveform 97 to the charge electrode which controls the voltage signal applied to the charge electrode. The charge electrode waveform repeats at least once during every print period (see definition below), and the waveform includes one or more print drop voltage states and one or more non-print drop voltage states. The charge electrode waveform is also independent of the input image data. The charge electrode 44 is associated with the liquid jet and is positioned adjacent to the break off point 32 of the liquid jet 43. When a non-zero voltage is applied to the charge electrode 44, an electric field is produced between the charge electrode and the electrically grounded liquid jet. The capacitive coupling between the charge electrode and the electrically grounded liquid jet induces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop. When the voltage level on the charge electrode is changed, the charge induced on the liquid jet changes due to the capacitive coupling between the charge electrode and the liquid jet. Hence, the charge on the newly formed drops can be controlled by varying the electric potential on the charge electrode.

In order to print a multi-tone image using the present invention the input image data needs to be converted to a multilevel image corresponding to the number of levels that are to be printed. Using 2-bit coding allows for three different print drop sizes and no print with 00 corresponding to white, 01 corresponding to a first gray, 10 corresponding to a second gray and 11 corresponding to black. Using 3-bit coding allows for 7 different print drop sizes and no print with 000 corresponding to white and 001-110 corresponding to 6 different gray densities and 111 corresponding to black. In general all of the different levels do not need to be utilized since generation of larger drops slows down the maximum print speed. Printing a drop of N times the fundamental print drop volume requires a time interval of N times the fundamental print drop period to generate a drop of that size. In the practice of this invention, we provide a print period of time duration N times the fundamental period of liquid jet break off where N is an integer greater than 1.

Figures 3A, 3B:
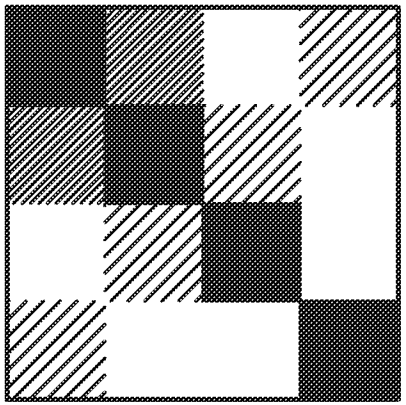
FIG. 3A shows an example of a 4 pixel by 4 pixel input image data (FIG. 3A) and the corresponding input pixel levels (FIG. 3B)
FIG. 3B shows input pixel levels corresponding to the 4 pixel by 4 pixel input image data shown in FIG. 3A.

When practicing this invention, input image data are provided having M levels per input image pixel where M is an integer and $2<M\leq N+1$. One of the M levels is a non-print level or white level. The M levels result in different shades of lightness and darkness or multi-tones when printed on the recording medium. FIG. 3A shows an example of a 4 pixel by 4 pixel input image data which uses a total of 5 levels including no print (white) (decimal 0), 3 levels of gray (decimal 1, 2 and 3) and black (decimal 4). FIG. 3B shows the corresponding input pixel levels shown in decimal notation. In order to create a 5 level image 3-bit encoding is required. Usually white decimal 0 would correspond to binary 000 and decimal 4 or binary 100 in 3-bit coding would correspond to black.

Figure 4B:
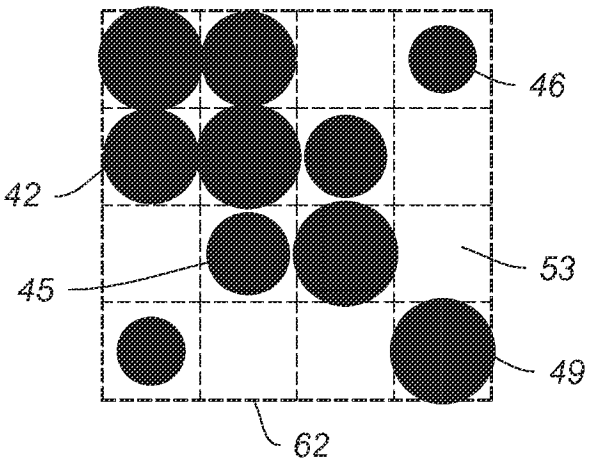
FIG. 4B shows print drops of the 4 by 4 pixel pattern shown in FIG. 3A being printed on a recording media.
Figure 4A:
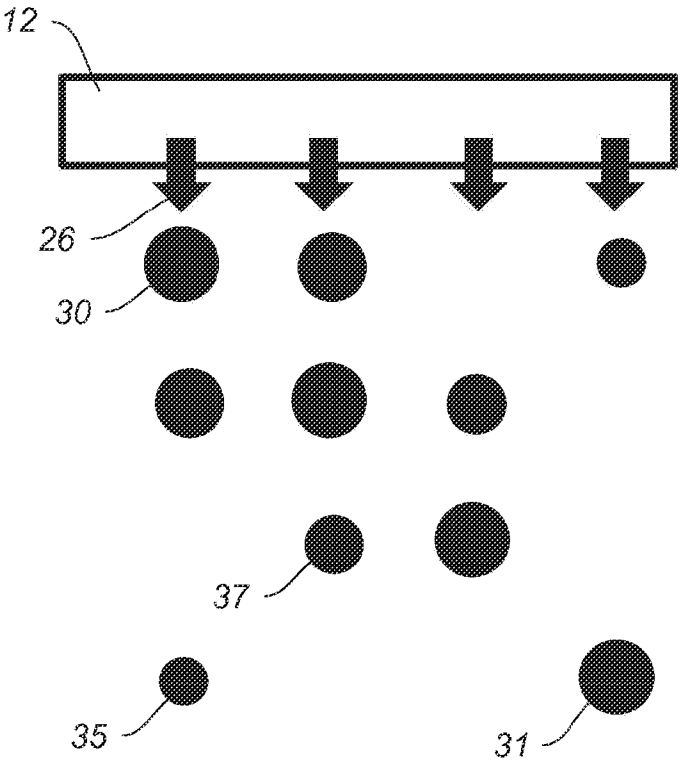
FIG. 4A shows the print drops traveling in air for the 4 by 4 pixel pattern shown in FIG. 3A.

FIG. 4A shows the print drops traveling in air after the non-print drops are deflected and captured by a catcher for the 4 by 4 pixel pattern shown in FIG. 3 assuming the bottom of the image is generated first. The liquid jet flow direction is indicated by arrows 26. The different size print drops being 1×, 2×, 3× and 4× are shown as 35, 37, 30 and 31 respectively. FIG. 4B shows the resultant printed drop pattern on the recording media produced by the drops traveling in air in FIG. 4A from the input image data of FIG. 3. In FIG. 4B the pixel boundaries are represented by shaded lines 62. The non-printed pixels or white pixels are represented by 53. The printed 1× drop is represented by 46, the printed 2× drop is represented by 45, the printed 3× drop is represented by 42 and the printed 4× drop is represented by 49. As N increases, the size of the printed drops increases resulting in an increased print average density when viewed by an observer.

The drop formation dynamics of drops forming from a liquid stream being jetted from an inkjet nozzle can be varied by altering the waveforms applied to the respective drop formation transducer associated with a particular nozzle orifice. Changing at least one of the amplitude, duty cycle or timing relative to other pulses in the waveform or in a sequence of waveforms can alter the drop formation dynamics of a particular nozzle orifice. In order to practice this invention, it is desirable that the drops formed of various volumes break off at approximately the same distance BL from the nozzle array. The drop formation waveforms and break-off timing to form drops of various volumes ranging 1-4 times the fundamental drop volume are described in FIGS. 5 and 6.

Figure 5:
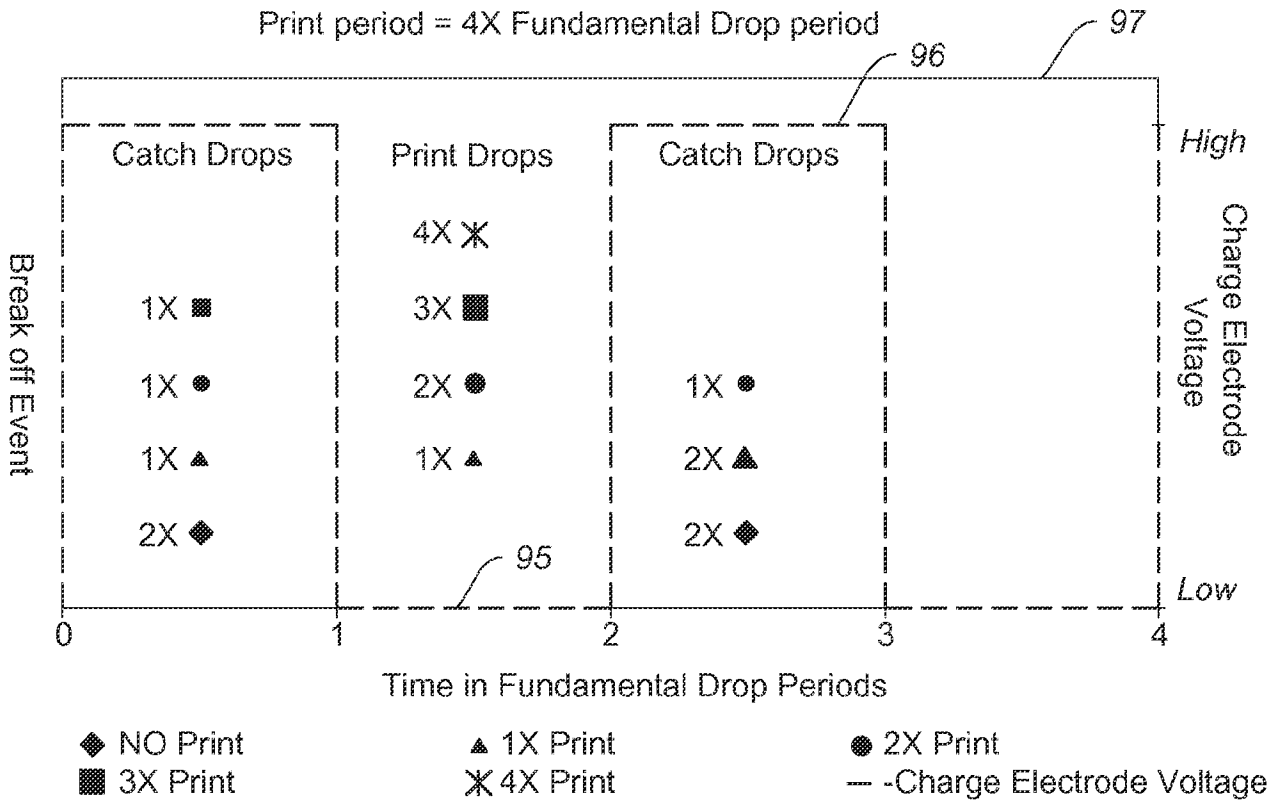
FIG. 5 shows the break off timing of various sized print drops and non-print drops along with the charge electrode voltage waveform state as a function of time shown in fundamental drop periods.
Figure 6:
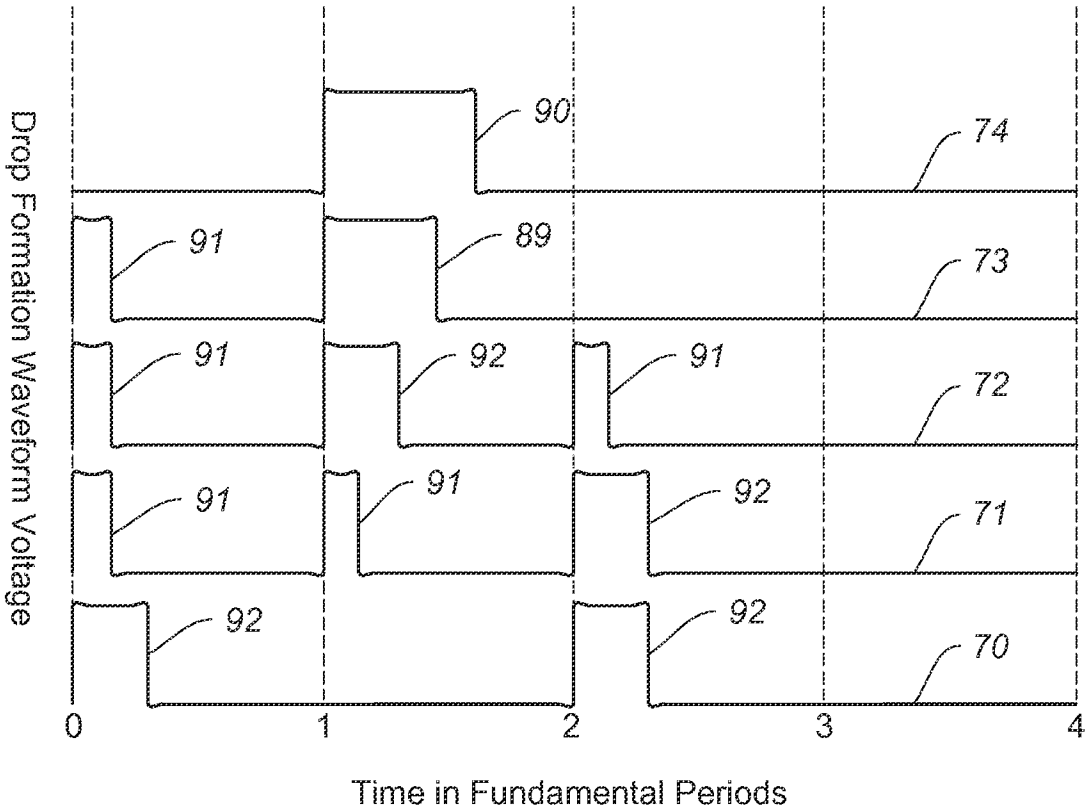
FIG. 6 shows example drop formation waveforms as a function of time used to generate the break off timing events shown in FIG. 5.

FIG. 5 shows an example timing diagram showing the break off timing of various sized print drops and non-print drops along with the charge electrode voltage waveform state as a function of time measured in fundamental drop formation periods for a single print period which is 4 fundamental drop formation periods long. The charge electrode waveform 97 shown is a 2 state waveform having a non-print drop voltage state 96, also called a catch drop voltage state 96, and a print drop voltage state 95 which is shown to repeat twice during a print period. Each voltage state is shown to be active for a fundamental drop formation period. The break off timing of drops for the various print drop size waveforms which are shown in FIG. 6 are also shown in FIG. 5. Print drops are formed when they break off adjacent to the charge electrode when the charge electrode is in the print drop voltage state 95 which produces a print drop charge to mass ratio on the print drops. Non-print drops, also called catch drops, are formed when they break off adjacent to the charge electrode when the charge electrode is in the non-print drop voltage state 96 which produces a non-print drop charge to mass ratio on the non-print drops. The print drop charge to mass ratio is different than the non-print drop charge to mass ratio. The print drop voltage state does not need to be at ground potential, and it is sometimes advantageous for it to be at a non-zero DC level. By having an appropriate DC bias during the break off of print drops, the charge on the print drops can be reduced to close to zero charge. In one embodiment, the DC bias is adjusted or selected so that the charge of the 1× print drops is at approximately zero charge, while the print drops of the other sizes may differ slightly from zero charge. The selection of the 1× drop as the drop to have zero charge being made as it has the smallest mass and is therefore more susceptible to electrostatic drop to drop interactions and the other print drops. To further reduce possible electrostatic drop to drop interactions, a phase shift can be applied between the drop formation waveforms applied to adjacent nozzles. For example the drop formation waveforms applied to the drop formation devices associated with the odd numbered nozzles can be delayed by ½ the print period, or equivalently by two times the fundamental drop formation period, relative to the drop formation waveforms applied to the drop formation devices associated with the even numbered nozzles. In this way, the spacing between print drops from adjacent nozzles can be increased reducing the electrostatic forces between slightly charged print drops.

Another way of reducing charge to mass ratio variations in print drops of different volumes includes using a non-print drop of a predetermined size that precedes print drops. For example, in a 4× period, print drops of 1×, 2× and 3× sizes, are preceded by a 1× non-print drop. This reduces the effect of drop pattern dependent electric fields in the jet break off area and helps to increase the consistency of charge to mass ratio on print drops.

The break off timing of the drops formed when using the no print drop waveform are shown as black diamonds; the break off timing of drops formed using the 1× print drop waveform are shown as black triangles, the break off timing of the drops formed when using the 2× print drop waveform are shown as black circles; the break off timing of the drops formed when using the 3× print drop waveform are shown as black squares and the break off timing of the drops formed when using the 4× print drop waveform are shown as crosses. The relative sizes of the symbols used to indicate the break off events correlates to the size of the drops that break off. Note that all of the print drops shown in FIG. 5 break off during the second fundamental time period during the print period. In general a constant phase delay is applied between the timing of the pulses applied to the drop formation transducers and the charge electrode waveform in order to properly synchronize the timing or the break off events so that print drops of the desired sizes break off during the print drop charge state of the charging voltage waveform and non-print drops break off during the non-print drop charge state of the charging voltage waveform.

FIG. 6 shows an example of drop formation waveforms as a function of time used to generate the break off timing events shown in FIG. 5. The drop formation waveform to be printed is based on input image data. The no print drop waveform 70 consists of a pair of 2× drop forming pulses 92 occurring during the first and third fundamental periods of the print period. The 1× print drop waveform 71 consists of a pair of 1× drop forming pulses 91 occurring during the first and second fundamental periods and a 2× drop forming pulse 92 occurring during the third fundamental period of the print period. The 2× print drop waveform 72 consists of a 1× drop forming pulse 91 during the first fundamental period, a 2× drop forming pulse 92 during the second fundamental period and a 1× drop forming pulse 91 during the third fundamental period of the print period. The 3× print drop waveform 73 consists of a 1× drop forming pulse 91 during the first fundamental period and a 3× drop forming pulse 89 during the second fundamental period of the print period. The 4× print drop waveform 74 consists of a 4× print drop forming pulse 90 during the second fundamental period of the print period. The waveforms 71-74 shown in FIG. 6 produce print drops of X times the fundamental volume in response to an input image pixel data level X, where $1 \leq X \leq N$. Other sets of timing diagrams could also be used to provide the various sized print drops. In all cases when the input image data level is 0, the waveforms are modulated to cause portions of the liquid jet to break off into one or more non-print drops. In the various drop formation waveforms 70, 71, 72, 73 and 74 shown in FIG. 6 the total energy applied to the drop formation transducer over the print period is the same.

FIG. 7 A-E shows a cross sectional viewpoint through a single liquid jet of an embodiment of the continuous liquid ejection system according to this invention while not printing in A, while printing 1× drops in B, while printing 2× drops in C, while printing 3× drops in D and while printing 4× drops in E using a four fundamental period long print period and the drop waveforms and timing shown in FIGS. 5 and 6. In the various embodiments of the invention, the continuous liquid ejection system 40 includes a printhead 12 comprising a liquid chamber 24 in fluid communication with an array of one or more nozzles 50 for emitting liquid jets 43. Liquid is supplied under a pressure sufficient to eject liquid jets through the nozzles of the liquid chamber. The liquid jets have a fundamental period of liquid jet break off. Associated with each liquid jet is a stimulation transducer 59. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulation of the liquid jet 43 in the form of drop stimulation waveforms 55 shown in FIG. 6 as 70, 71, 72 and 73 which are dependent on the input image data.

The energy and timing of the stimulation waveforms applied to the liquid jets is controlled so that all drops break off from the liquid stream 43 adjacent at the same distance 32 from the nozzle exit. As the various sized drops break off from the liquid jets 43 they travel along an initial path 87 as shown in FIG. 2. Throughout FIG. 7 A-E drops are indicated as circles of various sizes to indicate the relative size of the drops. Print drops are shown without any charge and non-print drops are shown as having a negative sign. Numerals 35, 37, 30 and 31 represent 1×, 2×, 3× and 4× print drops respectively and numerals 36 and 38 represent 1× and 2× non-print drops respectively. A deflection mechanism 14 is required to deflect non-print drops.

The deflection mechanism includes the charging device 83 consisting of the charge electrode 44, the charging voltage source 51 and the charge electrode waveform 97, the catcher 47 having catcher face 52 and the optional deflection electrode 66 with its deflection electrode voltage source 67. The charge electrode 44 is common to all of the nozzles of the plurality of nozzles in the printhead 12. The charging pulse voltage source 51 supplies a time varying electrical potential (charge electrode waveform 97) between the charging electrode 44 and the liquid jet 43 which is usually grounded. The charge electrode waveform repeats at least once during every print period, the waveform includes one or more print drop voltage states and one or more non-print drop voltage states and the charge electrode waveform is independent of the input image data. In the examples shown in FIG. 7, the charge electrode waveform repeats twice during a print cycle, which is 4 fundamental periods long, and has a print drop voltage state and a non-print drop voltage state as shown in FIG. 5. When a voltage potential is applied to charge electrode 44 located to one side of the liquid jet adjacent to the break off point, the charge electrode 44 attracts the charged end of the jet prior to the break off of a drop, and also attracts the charged drops 36 and 38 after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171 by J. Robertson, charged drops passing in front of a conductive catcher face cause the surface charges on the conductive catcher face 52 to be redistributed in such a way that the charged drops are attracted to the catcher face 52. In the embodiments shown in FIGS. 7A-7E, drops 36 and 38 are highly negatively charged and deflected toward and captured by the catcher 47 and recycled while the print drops 35, 37, 30 and 31 have a relatively low charge and are shown as being relatively undeflected. In practice, the print drops may be slightly deflected away from the catcher and allowed to hit the recording medium 19. For proper operation of the printhead 12 shown in FIG. 7A-7E, the catcher 47 and/or the catcher bottom plate 57 are grounded to allow the charge on the intercepted drops to be dissipated as the ink flows down the catcher face 52 and enters the ink return channel 58. The catcher face 52 of the catcher 47 makes an angle θ with respect to the liquid jet axis 87 shown in FIG. 2. Charged drops 36 and 38 are attracted to catcher face 52 of grounded catcher 47 and intercept the catch face 52 at charged drop catcher contact location 27 to form an ink film 48 traveling down the face of the catcher 47. The bottom of the catcher face has a curved surface of radius R, around which ink can flow from the catcher face 52 into the ink recovery channel 58. The ink recovery channel 58 is formed between the bottom of the catcher body and the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet.

Figures 7A, 7B, 7C, 7D, 7E:
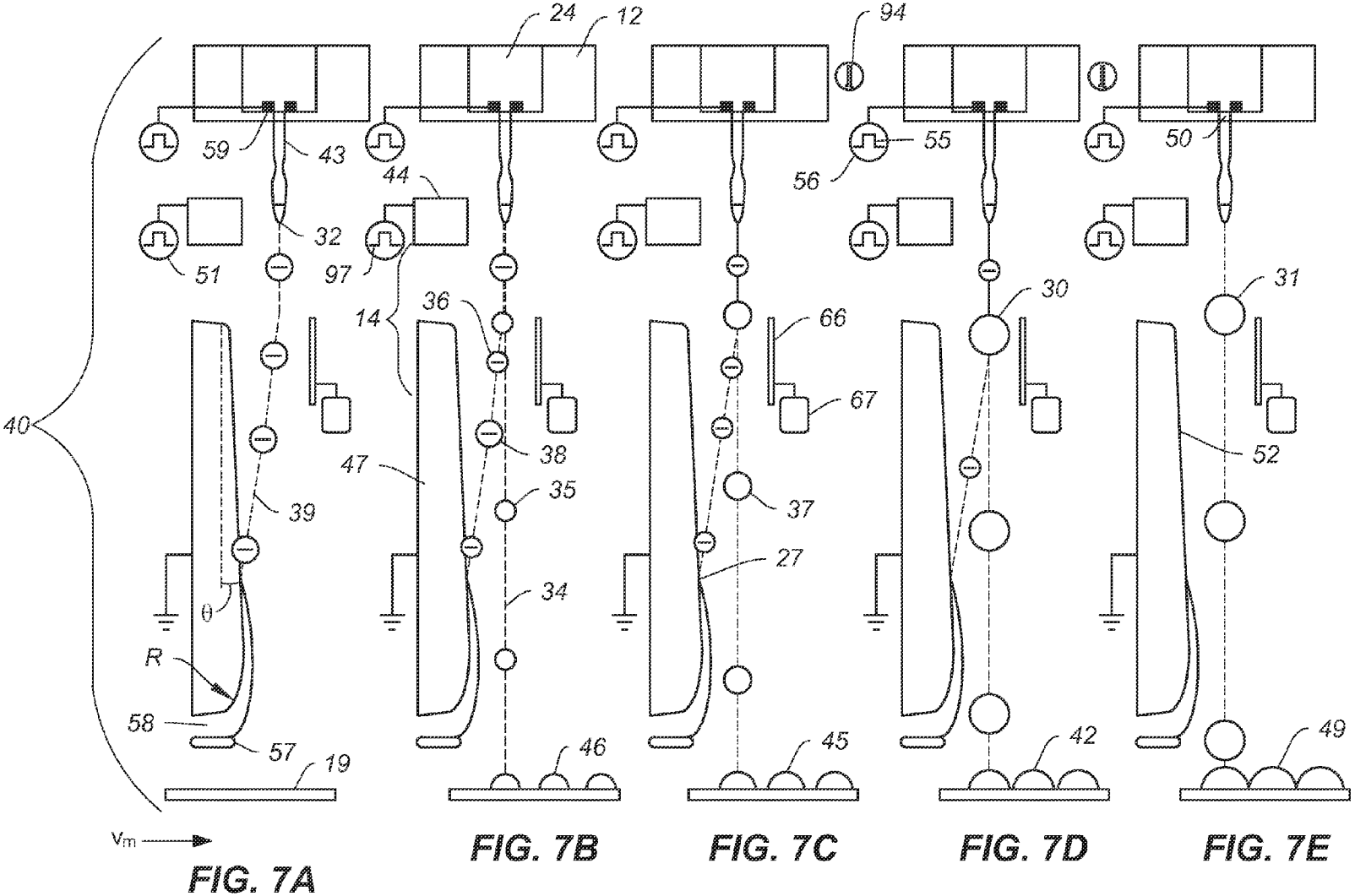
FIGS. 7A-7E show a cross sectional viewpoint through a liquid jet of an embodiment of a continuous liquid ejection system according to this invention with FIG. 7A showing a no print condition.

FIG. 7A shows a no print mode which uses the no print drop formation waveform 70 shown in FIG. 6 which causes the drops to break off from the jet 43 with the break off timing shown by the black diamonds in FIG. 5 relative to the charge electrode waveform. Only 2× negatively charged drops 38 are caused to break off and they are attracted to and captured by the catcher 47 and recirculated. These 2× non-print drops 38 follow the non-print drop trajectory or path shown by the dashed line 39. If used, the optional deflection electrode 66 would be supplied with a negative DC voltage by the deflection electrode voltage source 67.

FIG. 7B shows a IX drop print mode which uses the 1× print drop formation waveform 71 shown in FIG. 6 which causes the drops to break off from the jet 43 with the break off timing shown by the black triangles in FIG. 5. In this case, a single 1× drop is printed in every pixel as printed 1× drops 46 on recording medium 19 which is moving at velocity $v_m$. The 1× print drops 35 are relatively undeflected as they travel in air towards the recording medium 19 and follow the print drop trajectory or path shown by the dashed line 34. Both 1× non-print drops 36 and 2× non-print drops are attracted to and captured by the catcher 47 and recirculated as they travel along the non-print drop trajectory 39. The printed 1× drops 46 under-fill the pixel area as shown in FIG. 4B as indicated by the non overlapping drops on the recording medium 19 in FIG. 7B.

FIG. 7C shows a 2× drop print mode which uses the 2× print drop formation waveform 72 shown in FIG. 6 which causes the drops to break off from the jet 43 with the break off timing shown by the black circles in FIG. 5. In this case a single 2× drop is printed in every pixel as printed 2× drops 45 on recording medium 19 which is moving at velocity $v_m$. The 2× print drops 37 are relatively undeflected as they travel in air towards the recording medium 19 and follow the print drop trajectory 34. The 1× non-print drops 36 are attracted to and captured by the catcher 47 and recirculated as they travel along the non-print drop trajectory 39. The printed 2× drops 45 are larger than the printed 1× drops 46 but still under-fill the pixel area as shown in FIG. 4B as indicated by the non overlapping drops on the recording medium 19 in FIG. 7B.

FIG. 7D shows a 3× drop print mode which uses the 3× print drop formation waveform 73 shown in FIG. 6 which causes the drops to break off from the jet 43 with the break off timing shown by the black squares in FIG. 5. In this case a 3× drop is printed in every pixel as printed 3× drops 42 on recording medium 19 which is moving at velocity $v_m$. The 3× print drops 30 are relatively undeflected as they travel in air towards the recording medium 19 and follow along the print drop trajectory 34. The 1× non-print drops 36 are attracted to and captured by the catcher 47 and recirculated as they travel along the non-print drop trajectory 39. The printed 3× drops 42 are larger than the printed 2× drops 45 and the edges between adjacent drops formed from the same nozzle 50 touch at the boundaries between drops. As shown in FIG. 4B, the printed 3× drops still under-fill the pixel area.

FIG. 7E shows a 4× drop print mode which uses the 4× print drop formation waveform 74 shown in FIG. 6 which causes the drops to break off from the jet 43 with the break off timing shown by the crosses in FIG. 5. In this case a 4× drop is printed in every pixel as printed 4× drops 49 on recording medium 19 which is moving at velocity $v_m$. The 4× print drops 31 are relatively undeflected as they travel in air towards the recording medium 19 and follow along the print drop trajectory 34. In this case, none of the drops that break off from the jet 43 are attracted to and captured by the catcher 47 and recirculated. The printed 4× drops 31 are larger than the printed 3× drops 42.

Examples of simultaneously printing various sized drops on a recording medium using the drop formation waveforms shown in FIG. 6 are shown in FIG. 8. In each section A-C of FIG. 8, a sequence of drops is printed by an array of nozzles. The drops are printed well spaced apart to allow the size of the individual drops to be seen. In section A, the drop stimulation waveforms alternated between 1× print drop waveform and 3× print drop waveform, separated by several no print drop waveforms were applied to the drop formation device to print 1× drops 46 and 3× drops 42. In section B, the drop stimulation waveforms alternated between 1× print drop waveform and 2× print drop waveform, separated by several no print drop waveforms were applied to the drop formation device to print IX drops 46 and 2× drops 45. In section C, the drop stimulation waveforms alternated between 2× print drop waveform and 3× print drop waveform, separated by several no print drop waveforms were applied to the drop formation device to print 2× drops 45 and 3× drops 42. It is observed that the printed 1× drops 46 are smaller in diameter than the printed 2× drops 45 which are smaller in diameter than the printed 3× drops 42.

Figure 9:
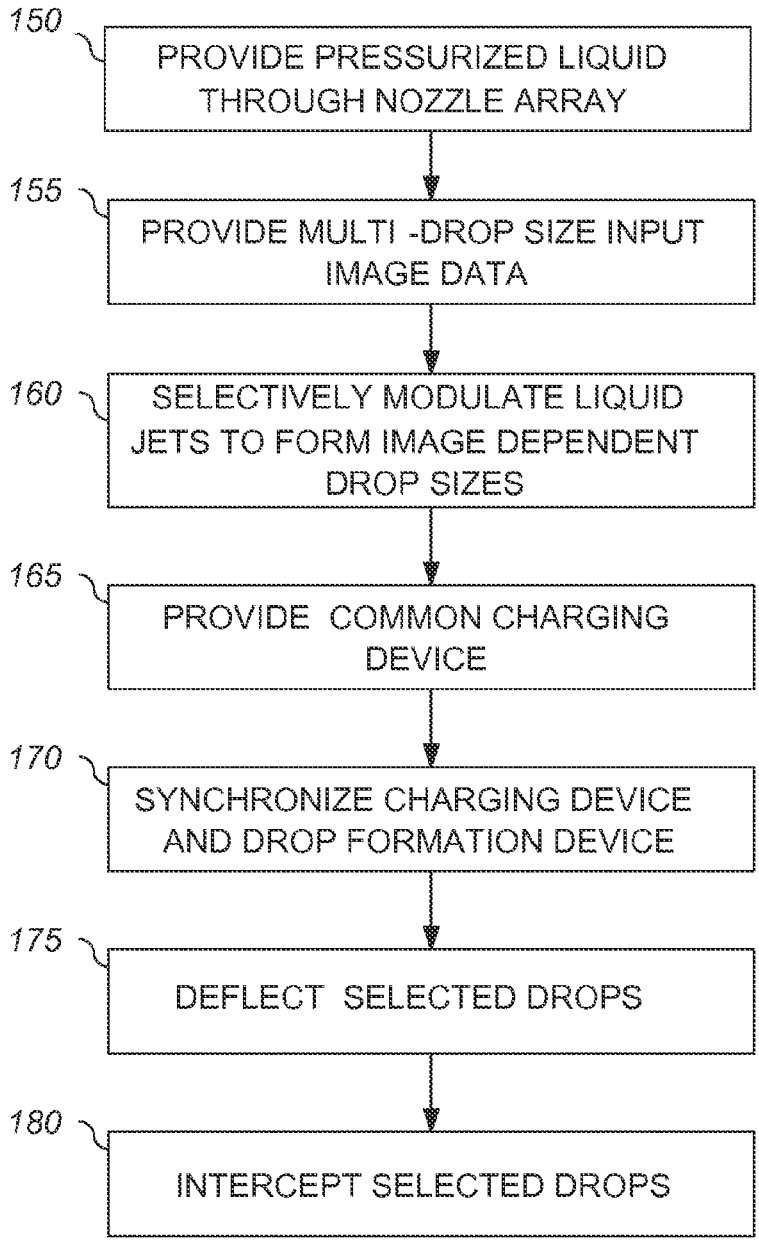
FIG. 9 shows a block diagram of a method of variable size drop printing according to an example embodiment of the invention.

FIG. 9 shows a block diagram outlining the steps required to practice the method of printing according to various embodiments of the invention. Referring to FIG. 9, the method of printing begins with step 150. In step 150, pressurized liquid is provided under a pressure that is sufficient to eject a liquid jet through a nozzle or a linear array of nozzles. Step 150 is followed by step 155.

In step 155, multi-drop size input image data is provided. A print period defined as N times the fundamental period of liquid jet break off where N is an integer greater than 1 is selected. The input image data has M levels per input image pixel including a non-print level where M is an integer and $2<M\leq N+1$. Step 155 is followed by step 160.

In step 160, the liquid jets are selectively modulated to cause portions of the liquid jets to break off into one or more drops of various sizes traveling along a path dependent on the input image data. The liquid jet is modulated using a drop formation device which selectively causes portions of the liquid jet to break off into sequences of print drops and a non-print drops traveling along an initial path by providing a plurality of waveforms to the drop formation device. Each of the plurality of waveforms has a period equal to the print period, and each waveform is selected in response to the input image data to form a print drop having a volume that corresponds to the level of the input image pixel. Step 160 is followed by step 165.

In step 165, a charging device is provided. The charging device includes a charge electrode and a source of time varying electrical potential. The charge electrode is common to and associated with each of the liquid jets. The source of time varying electrical potential applies a charge electrode waveform between the charge electrode and the liquid jets. The charge electrode waveform repeats at least once during each print period and includes one or more print drop voltage states and one or more non-print drop voltage states. The charge electrode waveform is independent of the input image data applied to the drop formation devices of the nozzles. Step 165 is followed by step 170.

In step 170, the charging device and the drop formation device are synchronized so that the print drop voltage state is active when print drops of various sizes break off from the jets and the non-print drop voltage state is active when non-print drops of various sizes break off from the liquid. This produces a print drop charge to mass ratio on print drops of various sizes as they break off from the liquid jet and produces a non-print drop charge to mass ratio on non-print drops of various sizes as they break off from the liquid jet, the print drop charge to mass ratio being different than the non-print drop charge to mass ratio. Step 170 is followed by step 175.

In step 175 non-print drops are print drops are caused to travel along different trajectories using a deflection mechanism. The deflection mechanism includes an electrostatic deflection device which causes the various sized non-print drops to travel along a non-print drop trajectory and causes the various sized print drops to travel along a distinct print drop trajectory, the print drop trajectory and the non-print drop trajectory being different. Thus, at least one of the print drops and the non-print drops deviate from the initial path using the deflection device. Step 175 is followed by step 180.

In step 180, drops traveling along one and only one of the first trajectory and the second trajectory are intercepted by a catcher for recycling. These drops are non print drops and the drops traveling along the other trajectory than the drops that are intercepted by the catcher are allowed to contact the recording medium and are printed.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz. The specific selection of these drop size, drop speed, nozzle size and drop generation frequency parameters is dependent on the printing application.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

In the embodiments of the various figures, the print drops were relatively uncharged and relatively undeflected, while the non-print drops were charged and deflected to strike the catcher. It other embodiments, the print drops can be charged and deflected and the non-print drops be relatively non-charged and relatively undeflected, with the catcher positioned to intercept the trajectory of the undeflected non-print drops.

The example embodiments discussed above with reference to FIGS. 1-9 are described using a particular combination of a drop charging structure, drop deflection structure, drop catching structure, and drop formation device. It should be understood that there are many known configurations of drop charging structures, of drop deflection structures, of drop catching structures, and drop formation devices, including some in which a single structure carries out multiple functions (such as an electrode structure that serves to both charge drops and deflect them) and various combinations of these structures can be employed.

The invention has been described in detail with particular reference to certain preferred embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
24 Liquid Chamber
26 Liquid Jet Flow Direction
27 Charged Drop Catcher Contact Location
30 3× Print Drop
31 4× Print Drop
32 Break off Location
34 Print Drop Trajectory
35 1× Print Drop
36 1× Non-Print Drop
37 2× Print Drop
38 2× Non-Print Drop
39 Non-Print Drop Trajectory
40 Continuous Liquid Ejection System
42 Printed 3× Drop
43 Liquid Jet
44 Charge electrode
45 Printed 2× Drop
46 Printed 1× Drop
47 Catcher
48 Ink Film
49 Printed 4× Drop
50 Nozzle
51 Charging Voltage Source
52 Catcher Face
53 White Pixels
54 Velocity Modulation Source
55 Drop Stimulation Waveform
56 Drop Formation Waveform Source
57 Catcher Bottom Plate
58 Ink Recovery Channel
59 Drop Formation Device
62 Pixel Boundaries
65 Arrow
66 Deflection Electrode
67 Deflection Electrode Voltage source
70 No Print Drop Waveform
71 1× Print Drop Waveform
72 2× Print Drop Waveform
73 3× Print Drop Waveform
74 4× Print Drop Waveform
83 Charging Device
87 Liquid Jet Central Axis
89 3× Drop Forming Pulse
90 4× Drop Forming Pulse
91 1× Drop Forming Pulse
92 2× Drop Forming Pulse
95 Print Drop Voltage State
96 Non-Print Drop Voltage State
97 Charge Electrode Waveform
150 Provide Pressurized Liquid Step
155 Provide Input Image Data Step
160 Modulate Liquid Jet Step
165 Provide Charging Device Step
170 Synchronization Step
175 Merge Drop Pairs Step
180 Deflect Selected Drops Step
185 Intercept Selected Drops Step

The invention claimed is:

1. A method of ejecting liquid drops comprising:

providing liquid under pressure sufficient to eject a liquid jet through a nozzle of a liquid chamber, the liquid jet including a fundamental period of liquid jet break off;

providing a drop formation device associated with the liquid jet;

providing a print period defined as N times the fundamental period of liquid jet break off where N is an integer greater than 1;

providing input image data having M levels per input image pixel including a non-print level where M is an integer and $2<M\leq N+1$;

providing a charging device including:

a charge electrode associated with the liquid jet; and a source of varying electrical potential between the charge electrode and the liquid jet, the source of varying electrical potential providing a waveform to the charge electrode, the waveform repeating at least once during every print period, the waveform including one or more print drop voltage states and one or more non-print drop voltage states, the waveform being independent of the input image data;

modulating the liquid jet using the drop formation device to selectively cause portions of the liquid jet to break off into a sequence of print drops and a non-print drops traveling along an initial path by providing a plurality of waveforms to the drop formation device, each of the plurality of waveforms having a period equal to the print period, each waveform being selected in response to the input image data to form a print drop having a volume that corresponds to the level of the input image pixel;

synchronizing the charging device and the drop formation device to produce a print drop charge to mass ratio on print drops as they break off from the liquid jet and to produce a non-print drop charge to mass ratio on non-print drops as they break off from the liquid jet, the print drop charge to mass ratio being different than the non-print drop charge to mass ratio; and causing at least one of the print drops and the non-print drops to deviate from the initial path using a deflection device.

2. The method of claim 1, wherein modulating the liquid jet includes causing portions of the liquid jet to break off into one or more non-print drops when the input image data level is 0 and causing portions of the liquid jet to break off into print drops of different volumes for each of the input image data pixel levels 1 to M.

3. The method of claim 1 wherein the volume of the print drop equals X times a fundamental drop volume, the fundamental drop volume corresponding to the fundamental period of liquid jet break off in response to an input image pixel data level X, where $1\leq X\leq N$.

4. The method of claim 1, further comprising;

intercepting drops traveling along the non-print drop path using a catcher.

5. The method of claim 1, wherein the print drops are substantially uncharged.

6. The method of claim 1, wherein the charge electrode is placed adjacent to the break off location of the liquid jets.

7. The method of claim 1, wherein the deflection device further comprises at least one deflection electrode to deflect charged drops, the at least one deflection electrode being in electrical communication with one of a source of electrical potential and ground.

8. The method of claim 1, wherein the deflection device further comprises a deflection electrode in electrical communication with a source of electrical potential that creates a drop deflection field to deflect charged drops.

9. The method of claim 1, wherein the print drop voltage state includes a non-zero DC level.

10. The method of claim 1, wherein the one or more print drop voltage states of the waveform provided by the source of varying electrical potential are equivalent.

11. The method of claim 1, wherein the one or more non-print drop voltage states of the waveform provided by the source of varying electrical potential are equivalent.

12. The method of claim 1, the nozzle being one of a plurality of nozzles, the charge electrode of the charging device comprising an electrode that is common to and associated with each of the liquid jets ejected from the nozzles of the plurality of nozzles.

13. The method of claim 12, wherein the plurality of nozzles are all the same size.

14. The method of claim 12, where the plurality of nozzles are arranged in two or more groups such that the print drops from the adjacent nozzles are not aligned.

15. The method of claim 1, wherein the drop formation device further comprises:

a drop formation transducer associated with one of the liquid chamber, the nozzle, and the liquid jet; and a drop formation waveform source that supplies the plurality of waveforms to the drop formation transducer.

16. The method of claim 15, wherein the drop formation transducer is one of a thermal device, a piezoelectric device, a MEMS actuator, an electrohydrodynamic device, an optical device, an electrostrictive device, and combinations thereof.

17. The method of claim 1, wherein the plurality of waveforms provided to the drop formation device is selected from a set of at least M waveforms.

18. The method of claim 17, wherein the plurality of waveforms each include a distinct sequence of pulses.

19. The method of claim 17, wherein a total energy applied to the drop formation transducer over the print period is the same for each of the plurality of waveforms.

* * * * *